US005839957A

United States Patent [19]

Schneider et al.

[11] Patent Number: 5,839,957

[45] Date of Patent: Nov. 24, 1998

[54] STEPPING MOTOR DRIVEN REEL MECHANISM HAVING AN ENCODER MEANS INTEGRALLY FORMED ON THE MOTOR: APPARATUS AND METHOD

[75] Inventors: Richard Schneider; Jay Stone; Thomas Miner, all of Las Vegas, Nev.

[73] Assignee: Casino Data Systems, Las Vegas, Nev.

[21] Appl. No.: 723,851

[22] Filed: Sep. 30, 1996

[51] Int. Cl.[6] ..... G07F 17/34

[52] U.S. Cl. ..... 463/20; 273/143 R

[58] Field of Search ..... 273/143 R; 463/20

[56] References Cited

U.S. PATENT DOCUMENTS

| | | |
|---|---|---|
| 4,095,795 | 6/1978 | Saxton et al. . |
| 4,138,114 | 2/1979 | Andersen . |
| 4,238,127 | 12/1980 | Lucero et al. . |
| 4,262,906 | 4/1981 | Heywood . |
| 4,273,334 | 6/1981 | Schöne et al. . |
| 4,492,379 | 1/1985 | Okada . |
| 4,515,366 | 5/1985 | Hamano . |
| 4,534,560 | 8/1985 | Okada . |
| 4,618,150 | 10/1986 | Kimura . |
| 4,635,937 | 1/1987 | Dickenson et al. . |
| 4,637,611 | 1/1987 | Hamada . |
| 4,657,256 | 4/1987 | Okada . |
| 4,669,731 | 6/1987 | Clarke . |
| 4,687,981 | 8/1987 | Okada . |
| 4,693,477 | 9/1987 | Dickenson et al. . |
| 4,700,948 | 10/1987 | Okada . |
| 4,711,452 | 12/1987 | Dickenson et al. . |
| 4,715,604 | 12/1987 | Okada . |
| 4,721,307 | 1/1988 | Okada . |
| 4,741,532 | 5/1988 | Okada . |
| 4,772,022 | 9/1988 | Yoshitomi . |
| 4,772,023 | 9/1988 | Okada . |
| 4,773,647 | 9/1988 | Okada et al. . |
| 4,826,169 | 5/1989 | Bessho et al. . |
| 4,889,339 | 12/1989 | Okada . |
| 4,911,449 | 3/1990 | Dickenson et al. . |
| 5,018,737 | 5/1991 | Okada . |
| 5,024,439 | 6/1991 | Okada . |
| 5,058,893 | 10/1991 | Dickenson et al. . |
| 5,152,529 | 10/1992 | Okada . |
| 5,178,390 | 1/1993 | Okada . |
| 5,209,477 | 5/1993 | Heidel et al. . |
| 5,380,008 | 1/1995 | Mathis et al. . |

FOREIGN PATENT DOCUMENTS

| | | | |
|---|---|---|---|
| 3109979 | 9/1982 | Germany | 273/143 R |
| 1550732 | 8/1979 | United Kingdom . | |

*Primary Examiner*—Benjamin H. Layno
*Attorney, Agent, or Firm*—Bernhard Kreten

[57] ABSTRACT

A reel mechanism for use in a gaming machine including an integrally formed stepping motor/encoder assembly operatively coupled to a rotatable reel having an annular row of various symbols which are to be sequentially displayed in a visual field. The stepping motor/encoder assembly includes an integrally formed encoder wheel and sensing means. A processor/controller is operatively coupled to the stepping motor/encoder assembly for controlling the stepping motor drive signals, reading signals from the sensing means and storing in an associated memory a plurality of encoded reel stop positions which are a representation of physical stop positions on the reel. The processor/controller signals the stepping motor to spin the reel and while the reel is spinning, a random number generator means associated with the processor/controller determines a reel stop which corresponds to a specific position of a the reel. Simultaneously, the processor/controller cooperates with the integrally formed encoder means to provide a precise and fast response time in determining reel spin direction and absolute reel position to precisely control the stepping motor drive signals to stop the reel such that a portion of the annular row of various symbols which is associated with the reel stop determined by the random number generator means properly appears in the visible field.

15 Claims, 10 Drawing Sheets

STEPPING MOTOR DRIVEN REEL MECHANISM HAVING AN ENCODER MEANS INTEGRALLY FORMED ON THE MOTOR: APPARATUS AND METHOD

FIELD OF THE INVENTION

The present invention relates generally to a reel mechanism for a gaming machine and, in particular, to one or more stepping motor driven reel mechanisms having an encoder means integrally formed on the motor for, inter alia, precisely determining absolute reel position, rotational direction of the reel and for providing feedback to a processor/controller for precisely stopping the reel based on a predetermined stop position.

BACKGROUND OF THE INVENTION

Devices are known in the prior art which accept wagers, conduct a single or series of random or pseudo-random events and based upon the outcome of those events, may issue an award. One popular form of these types of devices are generally known as slot machines. Typically, these slot machines utilize multiple rotatable reels or a video display to display a random combination of predetermined symbols.

Reel type slot machines are usually provided with three or more reels each bearing a plurality of symbols and each driven by a stepping motor. The reels are caused to be rotated by a player and subsequently come to a stop displaying in a visible field a random combination of symbols along a row or "win line" which may or may not be a winning combination causing a payout. For trouble free operation and player satisfaction, it is important that the combination of symbols accurately appear along the win line of the visible field.

Heretofore, each reel driven by a stepping motor was provided with a light-opaque lug which is detected by a sensor such as photosensor to produce a "home" or reference position signal corresponding to one position of the reel. All other positions of the reel are inferred by, for example, counting the number of pulses delivered to the stepping motor. Therefore, the accurate placement of the combination of symbols along the "win line" of the visible field relies on the assumption that the rotor of a stepping motor makes an equiangular revolution per driving pulse.

However, the problem with relying on this assumption is that there is occasionally a loss of synchronism namely, a discrepancy between the actual angular revolution of the rotor and the number of driving pulses applied to the stepping motor. Because of such loss of synchronism, this "home" position method fails to accurately determine the angular position of the rotating rotor and reel and until the home position is detected the reel remains unsynchronized. In addition, once the reel is unsynchronized there is no way to determine a subsequent position on the reel in which it is to stop in order to display the appropriate symbols along the win line of the visible field.

In addition, by disposing the light-opaque lug on the reel, a further problem arises in that the reel may become warped thereby impeding the lug from properly passing the sensor. Furthermore, the lug is apt to be damaged when mounting the reel on the rotor shaft of the stepping motor. Moreover, it is necessary to locate the sensor such that it reads the passing of the lug without impeding reel rotation when abnormalities in operation occur due to, among other things, reel imbalance, reel friction and/or reel wear. Such inconsistencies in operation result in unpredictable and unreliable operation of the machine.

Notwithstanding, existing slot machines fail to address and solve the problem of detecting small movements of the reel which may be a result of unauthorized tampering of the slot machines.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| | United States Patents | |
| 4,095,795 | June 20, 1978 | Saxton, et al. |
| 4,138,114 | February 6, 1979 | Andersen |
| 4,238,127 | December 9, 1980 | Lucero, et al. |
| 4,262,906 | April 21, 1981 | Heywood |
| 4,273,334 | June 16, 1981 | Schöne, et al. |
| 4,492,379 | January 8, 1985 | Okada |
| 4,515,366 | May 7, 1985 | Hamano |
| 4,534,560 | August 13, 1985 | Okada |
| 4,618,150 | October 21, 1986 | Kimura |
| 4,635,937 | January 13, 1987 | Dickinson, et al. |
| 4,637,611 | January 20, 1987 | Hamada |
| 4,657,256 | April 14, 1987 | Okada |
| 4,669,731 | June 21, 1987 | Clarke |
| 4,687,981 | August 18, 1987 | Okada |
| 4,693,477 | September 15, 1987 | Dickinson, et al. |
| 4,700,948 | October 20, 1987 | Okada |
| 4,711,452 | December 8, 1987 | Dickinson, et al. |
| 4,715,604 | December 29, 1987 | Okada |
| 4,721,307 | January 26, 1988 | Okada |
| 4,741,532 | May 3, 1988 | Okada |
| 4,772,022 | September 20, 1988 | Yoshitomi |
| 4,772,023 | September 20, 1988 | Okada, et al. |
| 4,773,647 | September 27, 1988 | Okada |
| 4,826,169 | May 2, 1989 | Bessho, et al. |
| 4,889,339 | December 26, 1989 | Okada |
| 4,911,449 | March 27, 1990 | Dickinson, et al. |
| 5,018,737 | May 28, 1991 | Okada |
| 5,024,439 | June 18, 1991 | Okada |
| 5,058,893 | October 22, 1991 | Dickinson, et al. |
| 5,152,529 | October 6, 1992 | Okada |
| 5,178,390 | January 12, 1993 | Okada |
| 5,209,477 | May 11, 1993 | Heidel, et al. |
| 5,380,008 | January 10, 1995 | Mathis, et al. |
| | Foreign Patents | |
| 1 550 732 GB | August 22, 1979 | Crowe, et al. |

SUMMARY OF THE INVENTION

The present invention is distinguished over the known prior art in a multiplicity of ways. For one thing, the present invention provides a stepping motor driven reel mechanism including an encoder means integrally formed on the motor thus eliminating, inter alia, encoder to rotor shaft runout and wobble. In addition, the encoder means includes an encoder wheel and a sensing means integrally formed within the encoder means. Thus, eliminating the "home" position method and the need to locate a sensor such that it reads the passing of a lug without impeding reel rotation when abnormalities in operation occur due to, among other things, reel imbalance, reel warp, reel friction and/or reel wear.

The present invention provides the encoder wheel with a plurality of concentrically disposed bands of indicia. One of the bands includes indicia in the form of equiangularly spaced slots disposed thereon. This slot band is used for direction determination and a its ability to create a symmetrical pulse train. In addition, at least one index band of indicia is provided. This band includes a plurality of indexes in the form of bars or windows which are each represented by a unique integer number of slots provided in the slot band. Thus, the encoder wheel is divided into a plurality of sectors each coded with a unique identity. Therefore, the reel only needs to subtend a portion of a revolution to discern the exact direction and position of each and every symbol disposed on the periphery of the reel.

Furthermore, the present invention provides a microprocessor which controls the stepping motor drive signal and reads the output of the encoder means to determine the exact direction and position of each and every symbol disposed on the periphery of the reel. The processor signals the motor to spin the reel and while the reel is spinning, a random number generator means associated with the microprocessor determines the ultimate symbol which should result when the spinning reel subsequently comes to a stop. Thus, the microprocessor may be programmed with unique codes which precisely define each reel stop position. Since each reel stop is absolutely encoded, the method of the present invention provides absolute confirmation that the reel is in the correct position on even a single stop move. This provides a high degree of security, for example, gaffing is much more difficult when small movements of the reel or encoder wheel produce immediate reel tilts. Therefore, the present invention is impervious to velocity and acceleration errors and eliminates additional motor controls to correct these errors.

The stepping motor includes a stator and a rotor having a rotor shaft. A first end of the rotor shaft is operatively coupled to the reel and a second opposing end of the rotor shaft is operatively coupled to the encoder wheel of the encoder means. The encoder wheel includes a plurality of concentrically disposed bands of indicia which are sensed by sensing means integrally formed within the encoder means. One of the bands includes indicia in the form of equiangularly spaced slots disposed thereon. When the stepping motor is engaged the encoder wheel rotates and the sensing means senses an alternating pattern of light and dark signals corresponding to the pattern of slots and solid portions of the band. The light pattern is fed to a signal processing circuit which is used to produce two outputs which are ninety degrees out of phase. These two outputs are commonly called channel "A" and channel "B" outputs. Typically, the signal processing circuit is designed such that a clockwise rotation of the encoder wheel produces a channel "A" signal which leads the channel "B" signal by ninety degrees and a counter clockwise rotation produces a channel "A" signal which lags the channel "B" signal by ninety degrees. Thus, the direction of the rotor shaft is determined.

If the slot band of encoder wheel is provided with (N) slots, the angular interval between any two slots must be equal to (360/N). If the sensor means outputs one pulse for each slot in the band, the count of the total number of pulses defines the angular displacement of the rotor shaft and thus the reel mechanism.

Therefore, theoretically, the total angle of revolution of the rotor shaft can be absolutely determined based on the angle of revolution per driving pulse and the total number of driving pulses applied.

However, there is occasionally a loss of synchronism namely, a discrepancy between the actual angular revolution of the rotor and the number of driving pulses applied to the stepping motor. Because of such loss of synchronism, it is difficult to determine accurately the angular position of the rotating rotor shaft and reel at any given moment. In addition, the band of slots in association with processing circuitry provides good directional sensing, but also fails to accurately determine the angular position of the rotating shaft and reel at any given moment. For example, one may be able to determine the direction of the rotating shaft but, the position of the shaft and the symbols on the annular row of symbols disposed on the reel periphery is not discernible.

To this end, the present invention provides the encoder wheel with a plurality of concentrically disposed bands of indicia. As noted, one of the bands is a slot band for, inter alia, direction determination. In addition, at least one index band of indicia is provided. This band includes a plurality indexes in the form of bars or windows which are each represented by a unique integer number of motor steps and/or slots provided on the slot band. Thus, as the rotor shaft is rotated, the unique number of steps/slots between successive bars or windows may be determined. Thus, the unique number of steps/slots provide the exact location of the rotor shaft and of each and every symbol disposed on the periphery of the reel mechanism.

Preferably, there are two bands of indexes concentrically disposed with respect to one another. An outermost band includes a plurality of indexes in the form of pairs of bars separated by a unique integer number of the equiangularly spaced slots disposed on the slot band. An innermost band includes a plurality of indexes in the form of pairs of windows which are radially offset with respect to a corresponding pair of bars. Thus, the sensor monitors both bands simultaneously to obtain a differential signal correlative to whether an index of position has occurred.

By determining the occurrence of a first index of position and a second index of position by scanning the inner and outer bands a unique number of slots between these two position delineate the exact position of the reel without any inference. Thus, the precise location of each symbol on the annular row of symbols is known and such that a processor may send an unique, drive signal to the motor to precisely locate any symbol along the win line of the gaming machine.

In addition, the rotor shaft only needs to subtend a portion of a revolution for the exact direction and position of symbols to be known. Furthermore, with multiple indexes per revolution, position accuracy is greatly enhanced. This provides a higher degree of security, for example, gaffing is much more difficult when small movements of the reel mechanism or encoder wheel produce immediate reel tilts.

OBJECTS OF THE INVENTION

Accordingly, it is an object of the present invention to provide a new and novel reel mechanism according to the present invention.

It is a further object of the present invention to provide a reel mechanism as characterized above which includes an integrally formed encoder/stepping motor assembly.

It is a further object of the present invention to provide a reel mechanism as characterized above which includes a unique encoding scheme to define reel stops on a gaming reel.

It is a further object of the present invention to provide an encoder reel within the encoder/stepping motor assembly which includes a plurality of concentrically disposed bands of indicia scanned and then fed back to a processor for discerning shaft rotation direction and absolute position.

Another further object of the present invention is to provide a reel mechanism as characterized above which precisely controls stepping motor drive signals to stop a reel operatively coupled to the motor such that a portion of an annular row of various symbols are precisely displayed in a visible field.

Another further object of the present invention to provide a reel mechanism as characterized above which detects movements of the reel which may be associated with unauthorized tampering and to signal an alarm as a result of such tampering.

Another further object of the present invention to provide a reel mechanism as characterized above which is extremely durable in construction, automated for efficiency, accuracy and reliable use.

Another further object of the present invention to provide a reel mechanism as characterized above which includes an encoder wheel having a plurality of indicia which delineate the encoder wheel into a plurality unique discrete sectors which when scanned by a sensing means generate signature signals correlative to the direction of a reel and the absolute position of each and every symbol disposed of a periphery of the reel.

Viewed from a first vantage point it is an object of the present invention to provide a method for forming an apparatus for assessing position of at least one reel vis-a-vis reward obligations based on a position of the reel, the steps including: scanning an indicia coupled to a monitor which in turn drives a reel for determining reel position, communicating the reel position to a controller, randomly deciding a next reel stop position, and directing the controller to stop the reel at the next reel stop position.

Viewed from a second vantage point it is an object of the present invention to provide an apparatus for assessing position of at least one reel vis-a-vis reward obligations based on a position of the reel, comprising in combination: indicia means operatively coupled to a motor, the one reel operatively coupled to the motor, sensing means addressing the indicia means, means to power the motor and communicating with the sensor, and random number generating means interposed between the sensing means and the power means to control reel position.

Viewed from a third vantage point it is an object of the present invention to provide a reel mechanism for use in a gaming machine, comprising in combination: a reel having an annular series of various symbols of the gaming machine disposed about a periphery of the reel; a motor operatively coupled to the reel; the motor including a stator and a rotor having a rotor shaft, the rotor shaft having a first end and a second end; the first end of the rotor shaft operatively coupled to the reel wherein the annular series of various symbols forms an outer apron about the motor; a disk, the disk operatively coupled to the second end of the rotor shaft; the disk having a plurality of concentrically disposed bands of indicia having a fixed relationship with respect to one another; the plurality of concentrically disposed bands of indicia including at least a first band and a second band; the first band having a plurality of equiangularly spaced indicia disposed thereon; the second band having a plurality of indicia in the form of indexes which are separated by a unique integer number of said equiangularly spaced indicia disposed on the first band; a sensor means strategically disposed adjacent the concentrically disposed bands of indicia for sensing and outputting a signature signal representative of the integer number of the equiangularly disposed indicia which subtend an arc between two consecutive sensed indexes disposed on the second band wherein a processor/controller operatively coupled to the sensor controls reel position and direction of the reel based on the sensed signature signal.

Viewed from a fourth vantage point it is an object of the present invention to provide a reel mechanism for use in a gaming machine, comprising in combination: an integrally formed encoder and motor; a reel having an annular series of various symbols of the gaming machine disposed about a periphery of the reel; the reel rotatably coupled to the motor; the encoder including means for scanning an indicia coupled to the motor which in turn drives the reel for determining a reel position signature, a feedback loop operatively coupled between the encoder and the processing means for communicating the signature to the processor for directing the motor to stop the reel at a predetermined next reel stop position; wherein the processor correlates the position of the reel vis-a-vis reward obligations based on a paytable.

These and other objects will be made manifest when considering the following detailed specification when taken in conjunction with the appended drawing figures.

DESCRIPTION OF PREFERRED EMBODIMENTS

Figure 1:
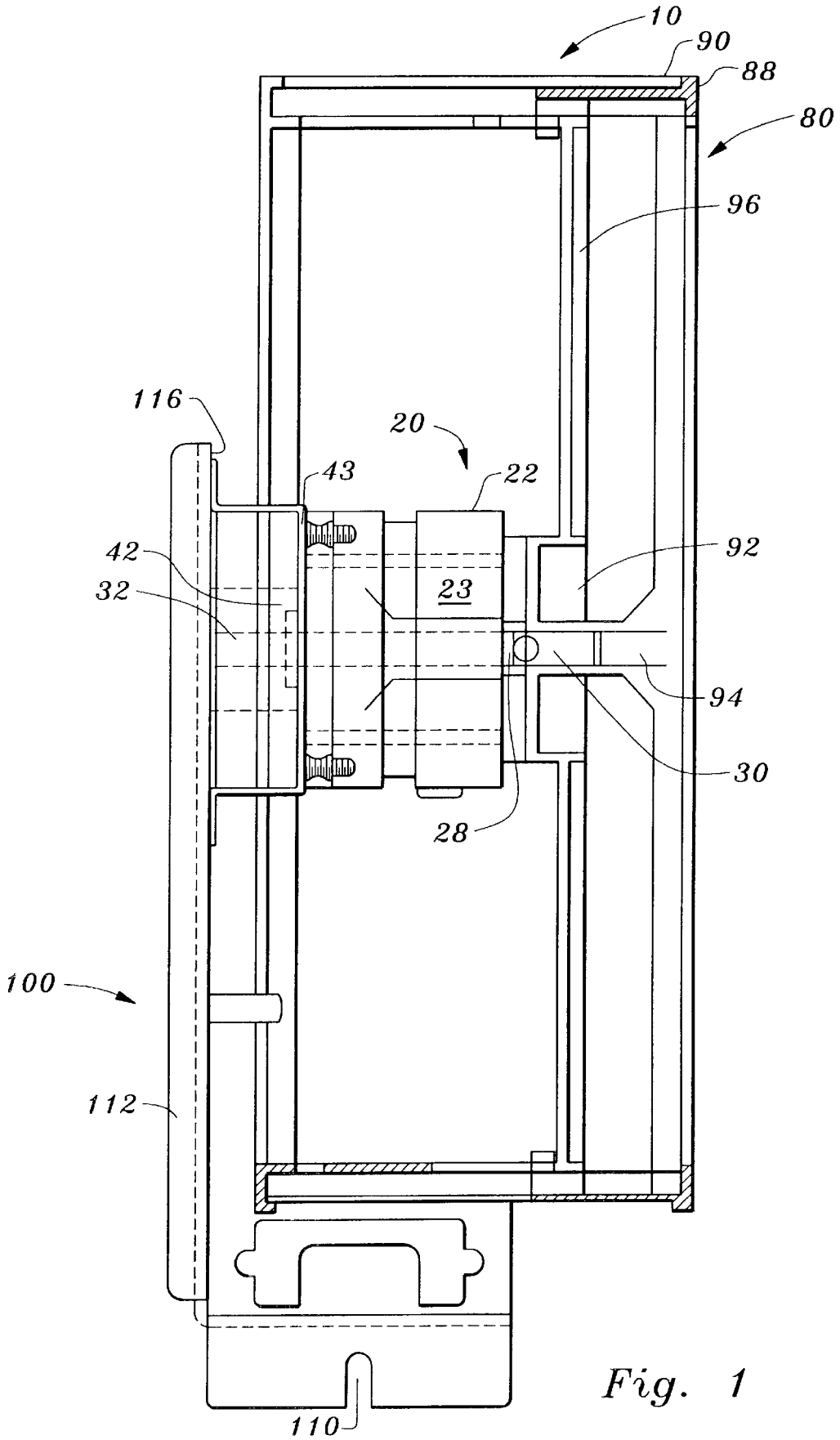
FIG. 1 is a front view of the reel mechanism according to the present invention showing a cross-section of a reel in order to reveal an integrally formed stepping motor/encoder assembly.

Considering the drawings, wherein like reference numerals denote like parts throughout the various drawing figures, reference numeral 10 is directed to a reel mechanism for a gaming machine according to the present invention.

Figure 2:
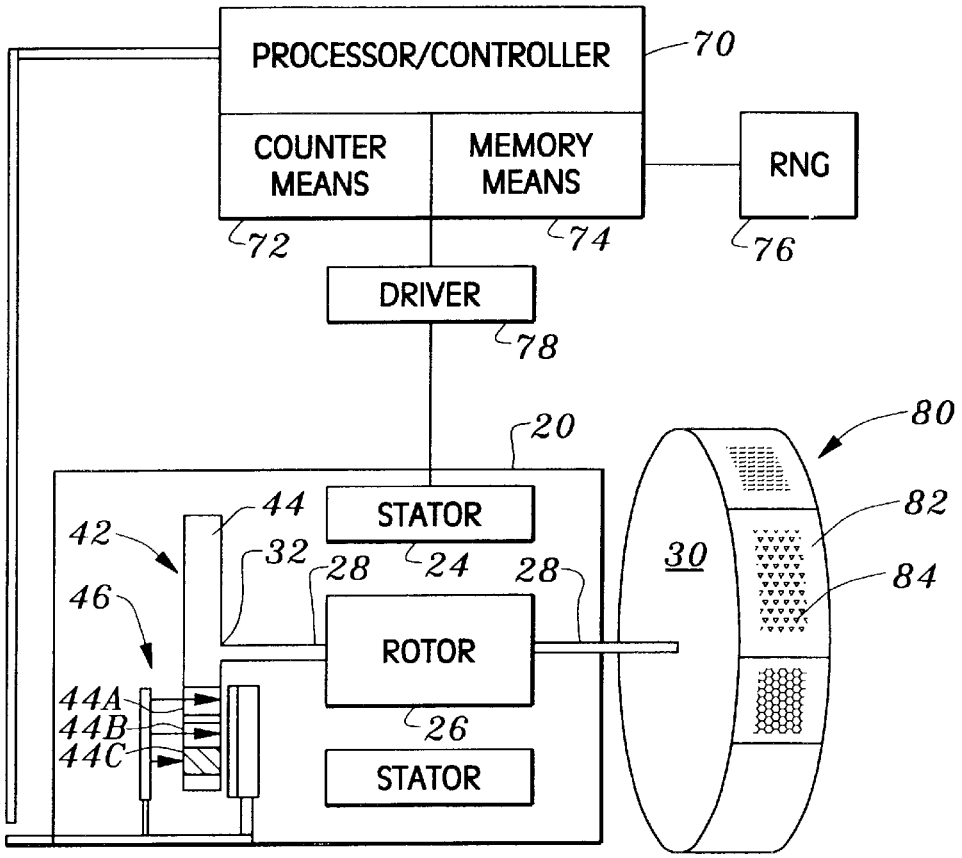
FIG. 2 is a basic block diagram of the electronics associated with the stepping motor/encoder assembly according to the present invention.

In essence, and referring to FIGS. 1 and 2, a reel mechanism 10 includes an integrally formed stepping motor/encoder assembly 20 operatively coupled to a rotatable reel 80 having an annular row 82 of various symbols 84 which are to be sequentially displayed in a visual field 126 (FIG. 5) of a gaming machine 120. The stepping motor/encoder assembly 20 includes an integrally formed encoder wheel 44 and sensing means 46. A processor/controller 70 is operatively coupled to the stepping motor/encoder assembly 20 to, inter alia, provide the drive signal which orchestrates the control of the stepping motor 22, read signals from the sensing means 46, and store in an associated memory 74, a plurality of encoded reel stop positions which are a representation of physical stop positions on the rotatable reel 80. The processor/controller signals the stepping motor 22 to spin the reel 80 and while the reel 80 is spinning, a random number generator means 76 associated with the processor/controller 70 determines a reel stop which corresponds to a specific position of the reel 80. Simultaneously, the processor/controller 70 receives feedback signals from the integrally formed encoder 42 and then processes these signals to determine reel spin direction and absolute reel position. The processor/controller 70 then uses this information to output a drive signal which orchestrates the control of the stepping motor 22 to stop the reel 80 such that a portion of the annular row 82 of various symbols 84 which is associated with the reel stop determined by the random number generator means 76 is properly displayed in the visible field 126 and precisely located along a "win line" 128 of the gaming machine 120. Preferably, a high resolution stepping motor/encoder assembly 20 is used to provide, inter alia, a precise and fast response time.

More specifically, and referring to FIGS. 1 and 2, the motor/encoder assembly 20 is operatively coupled to and extends away from an inner surface 116 of a reel plate 112. The integrally formed encoder 42 is operatively coupled to the stepping motor 22 and is interposed between the inner surface 116 of the reel plate 112 and the motor 22. The stepping motor 22 includes a housing 23 enclosing a stator 24 and a rotor 26 having a rotor shaft 28. The shaft 28 of the rotor 26 includes a first end 30 and a second end 32. The first end 30 of the rotor shaft is operatively coupled to the reel 80.

The reel 80 includes a rim 88 having an outer periphery 90, a hub 92 having a centrally disposed hub bore 94 and a plurality spokes 96. Preferably, the rim 88, the hub 92 and the spokes 96 are integrally formed with one another such that hub 92 is concentrically disposed within the rim 88 and the spokes are disposed at equally spaced intervals and radially extend between the hub 92 and the rim 88.

The first end 30 of the shaft 28 is received within the hub bore 94 of the reel 80. The annular row 82 of various symbols 84 are disposed in an series about the outer periphery 90 of the rim 88 of the reel 80 thereby forming an outer apron circumscribing the motor/encoder assembly 20.

The stepping motor/encoder assembly 20 includes an integrally formed encoder 42 having a housing 43 enclosing the encoder wheel 44 and the sensing means 46. The encoder wheel 44 is operatively coupled to the second end 32 of the rotor shaft 28.

Figure 4:
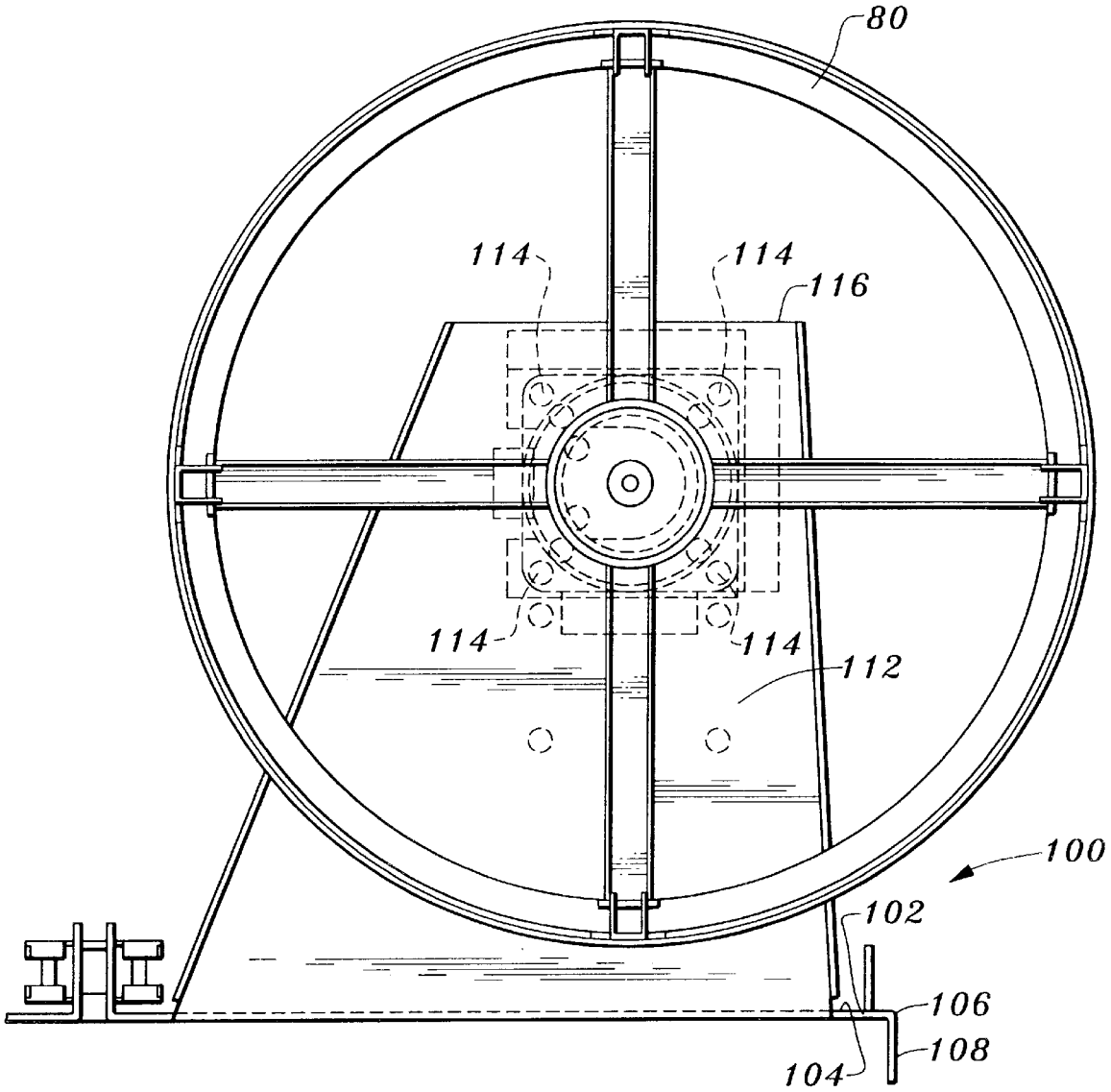
FIG. 4 is a side view of the reel mechanism coupled to a support bracket according to the present invention.
Figure 5:
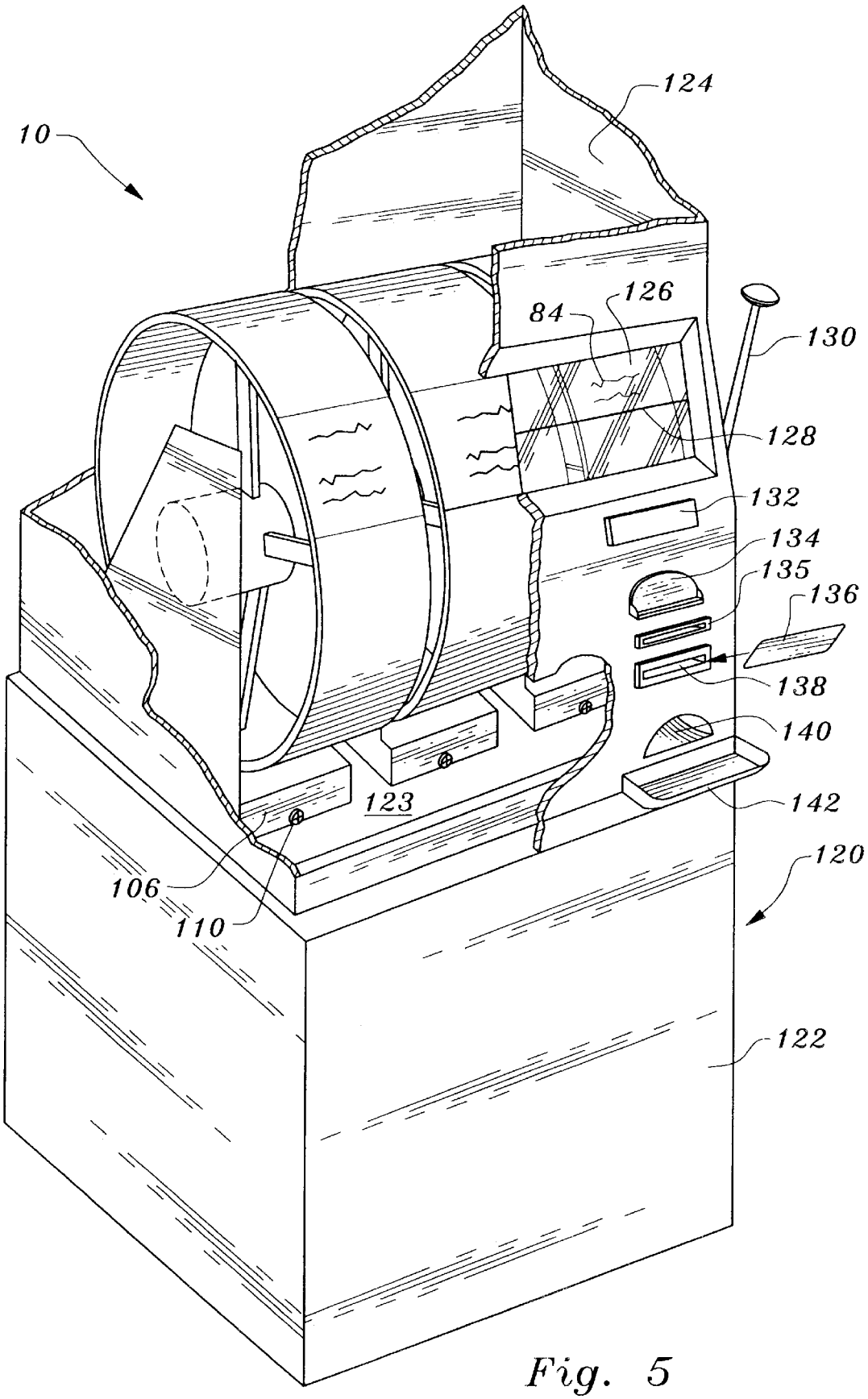
FIG. 5 is a partial cutaway view of a gaming machine showing a plurality of reel mechanisms disposed therein according to the present invention.

Referring to FIG. 4, a side view of a support bracket 100 is shown. The support bracket 100 includes an elongate support member 102 having a top surface 104 and a flange 108 downwardly extending from a front end 106 of the elongate support member 102. The flange 108 is provided with a notch 110 (FIG. 1) in which a screw may be passed through to attach the support bracket to the top surface 123 of the base 122 (FIG. 5). The support bracket 100 further includes a support means preferably defined by a trapezoidal shaped reel plate 112. The reel plate 112 upwardly extends from an edge of the elongate support member 102 and is provided with a symmetric bolt pattern 114 adjacent an upper end 115 of the reel plate 112. The motor/encoder assembly 20 is operatively coupled to the reel plate 112 and extends away from an inner surface 116 of the reel plate 112. The motor/encoder assembly 20 may be provided with a bolt pattern complemental to that of the symmetric bolt pattern 114 such that the motor/encoder assembly 20 may be directly coupled to the reel plate 112. Alternatively, an adapting bracket may be used to operatively couple the motor/encoder assembly 20 to the reel plate 112.

Figure 3:
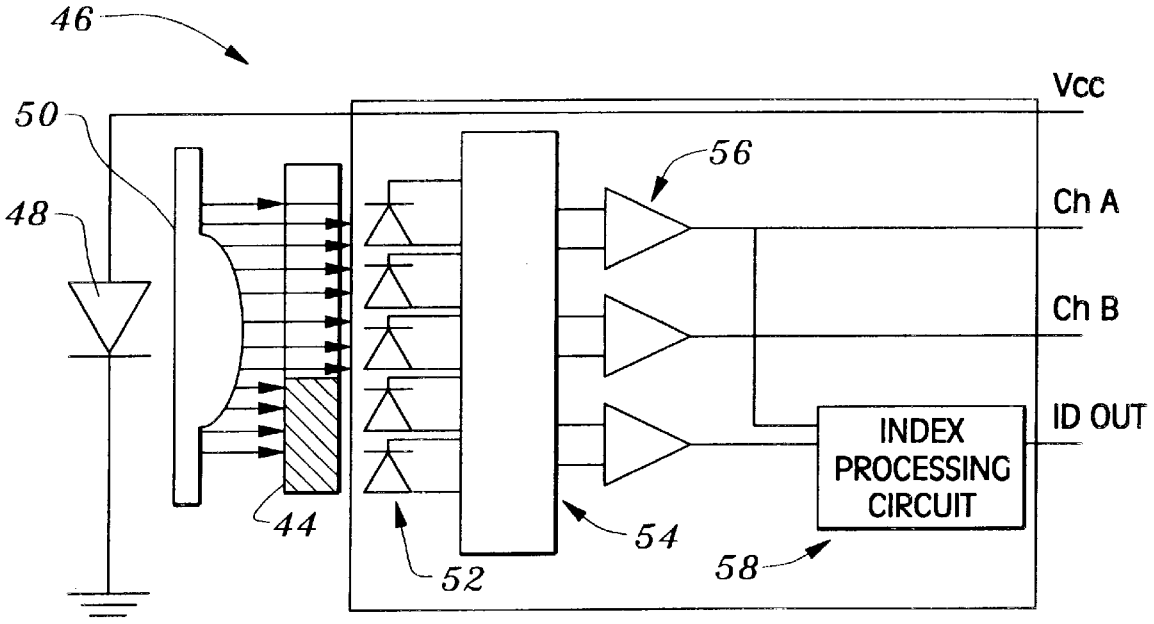
FIG. 3 is a schematic view of a sensor means of the encoder according to the present invention.
Figure 6:
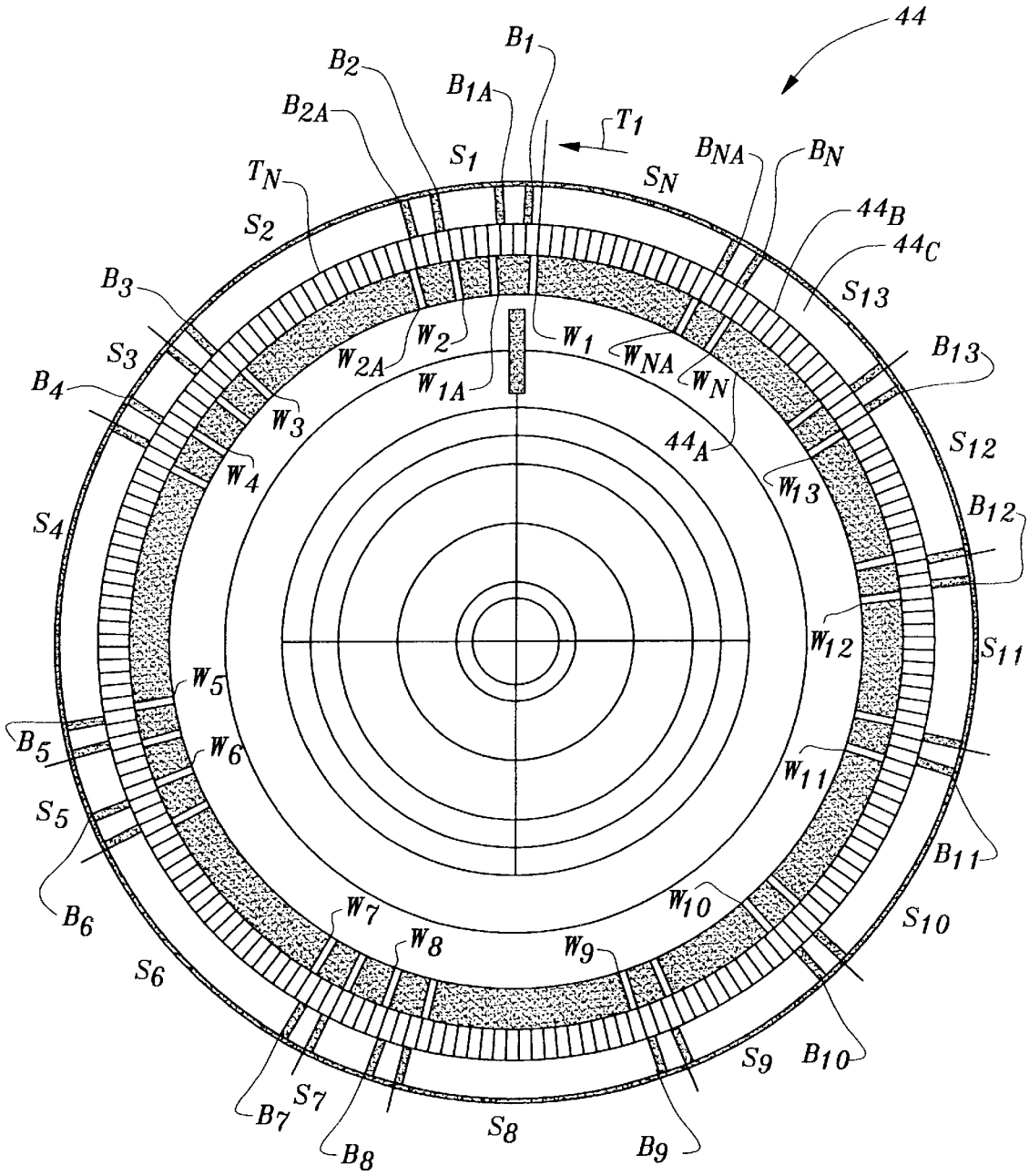
FIG. 6 is a plan side view of an encoder wheel according to the present invention.

In one preferred form, and referring to FIGS. 2 and 3, the encoder wheel 44 includes a plurality of concentrically disposed bands of indicia 44A, 44B and 44C (please also see FIG. 6). The indicia of the bands 44A, 44B and 44C are sensed by sensing means 46 integrally formed within the encoder 42 and strategically disposed adjacent the plurality of concentrically disposed bands of indicia 44A, 44B and 44C. Preferably, the sensing means 46 is an optical emitter/detector module which includes a light emitting diode (LED) 48, a collimating lens 50, photodetectors 52, a signal processing circuit 54, comparators 56 and an index processing circuit 58. The LED 48 and the collimating lens 50 are placed adjacent one another and strategically located adjacent the plurality of concentrically disposed bands of indicia 44A, 44B and 44C such that a collimated beam of light emitted from the LED 48 and lens 50 is cast on one side of the plurality of concentrically disposed bands of indicia 44A, 44B and 44C. This beam falls on the photodetectors 52 when it is uninterrupted by the concentrically disposed bands of indicia 44A, 44B and 44C. The dark and light periods created by the light cast on the concentrically disposed bands of indicia is detected by the photodetectors 52 and processed by the signal processing circuit 54 and then outputted to the comparators 56 which provide channel A and channel B outputs. The outputs of the comparators 56 are also processed by the index processing circuit 58 which outputs a differential signal (ID out). The sensing means 46 may include a monolithic chip having a photo sensitive area (photodetectors 52) on the chip which is laid out to match the desired area of the encoder wheel which is to be monitored.

Referring to FIG. 6, the plurality of concentrically disposed bands of indicia 44A, 44B and 44C are shown in detail. In one preferred embodiment, band 44B is the center band which includes indicia in the form of slots equiangularly spaced along its outer edge. Band 44C is the outermost band and includes a plurality of indicia in the form of index bars B1 through BN (as shown N=14) which are separated from one another by a unique integer number of the equiangular spaced slots disposed in the central band 44B. Band 44A is the inner band which includes a plurality of indicia in the form of windows W1 through WN (as shown N=14) which are used in combination with the outermost band of bars to generate a differential output signal. Note that the windows W are radially offset from the bars B.

Preferably, the index bars B1 through BN delineate N sectors of unequal area around the encoder wheel 44. For example, when viewing the wheel in a counter clockwise direction, the wheel is divided into 14 sectors (N=14) defined as the area between the start of one bar (BN) to the start of a second immediately subsequent bar (BN +1) or by the number of slots equiangularly spaced between the start of one bar (BN) to the start of a second bar (BN +1).

For greater resolution, pairs of adjacent bars (B1,B1A) through (BN,BNA) are disposed on the other band 44C and are used as indexes in combination with respective pairs of adjacent windows (W1,W1A) through (WN,WNA) which are disposed on the inner band 44A in a radially offset pattern with respect to the adjacent bars (B1,B1A) through (BN,BNA). The signals from the sensor means which senses the presence of the bar pairs and window pairs are processed to form a differential signal which unequivocally defines the position of the reel shaft 28 and thus the symbols 84 disposed on the outer periphery 90 of the reel 80.

Figure 7:
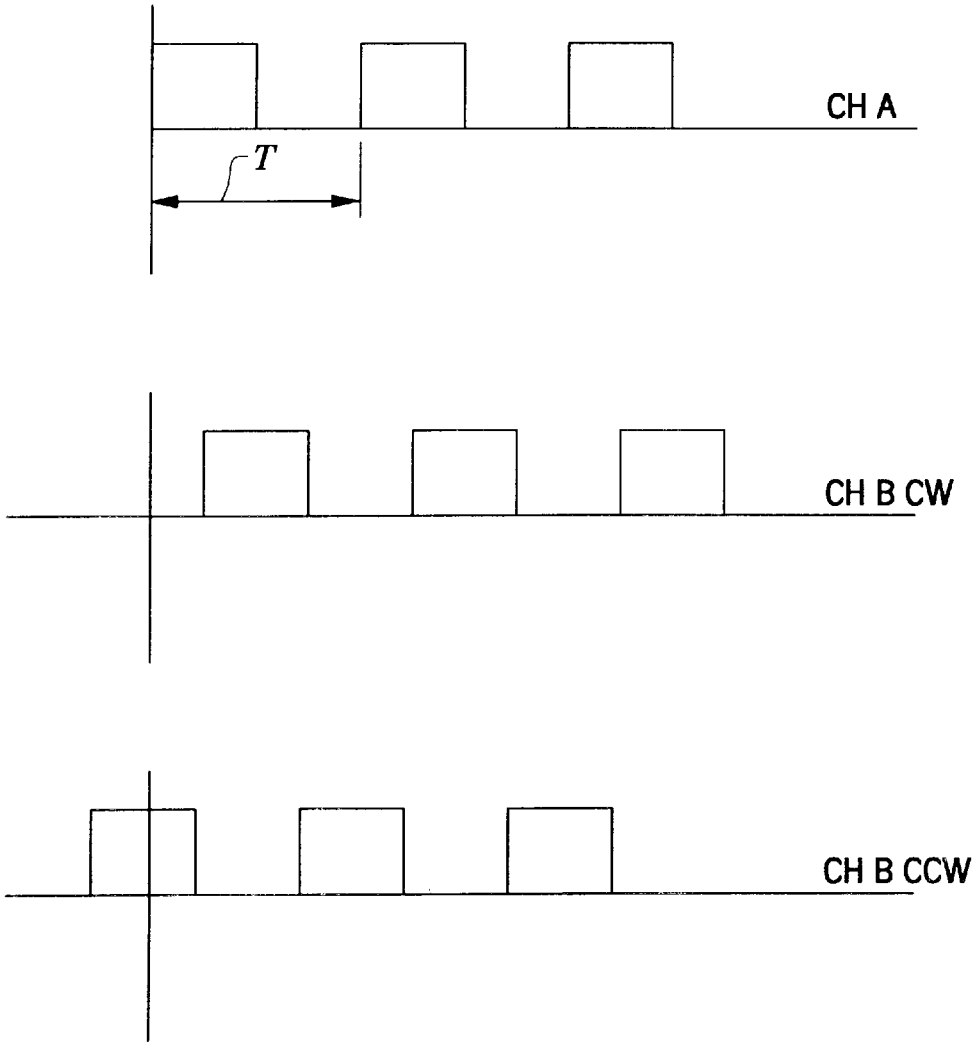
FIG. 7 is an illustrative timing diagram of the direction of the encoder wheel according to the present invention.

Referring to FIGS. 7, a timing diagram is shown of the output waveforms of channel A and channel B of the sensing means 46. These waveforms result when the encoder wheel 44 is rotated, causing the light beam to be interrupted by the equiangularly spaced slots disposed on the center band 44B. When the stepping motor 22 is energized by the processor/controller 70 the encoder wheel rotates and the sensing means 46 senses an alternating pattern of light and dark signals corresponding to the pattern of slots and solid portions of the center band 44B. The light pattern is fed to the signal processing circuit 54 which is used to produce "A" and "B" outputs which are ninety degrees out of phase. Typically, the signal processing circuit 54 is designed such that "A" leads "B" in a clockwise shaft rotation and "A" lags "B" in a counterclockwise shaft rotation. Thus, the direction of the rotor shaft 28 is determined and feedback to the processor/controller 70.

The center band 44C may also be used to determine the angular velocity and the angular displacement of the shaft 28. If the center band 44C of encoder wheel 44 is provided with N slots, the angular interval between any two slots equals (360°/N). For example, if there are two hundred slots the angular interval between any two slots equals 1.8° and the sensing means 46 outputs at, for example, channel A one pulse per 1.8° or for each slot in the center band 44C. Therefore, the period T (FIG. 7) of the signal outputted at channel A may be used to determine the angular velocity "ω" from the formula (ω=(60/NT)). In addition, the count of the number of pulses "P" outputted at channel A may be related to the angular displacement "ω" of the rotor shaft 28. If "P" pulses are outputted the rotor shaft 28 should move an angle "ω" which is equal to (360P/N).

Theoretically, therefore, the total angle of revolution of the rotor shaft can be determined based on the angle of revolution per driving pulse (360/N) and the total number P of driving pulses applied.

However, there is occasionally a loss of synchronism namely, a discrepancy between the actual angular revolution of the rotor and the number of driving pulses applied to the stepping motor. Because of such loss of synchronism, it is difficult to accurately determine the angular position of the rotating shaft 28 and reel 80 at any given moment. As a result, one may be able to determine the direction of rotation of the shaft 28 but unable to accurately determine the angular position of the rotating shaft 28 and reel 80. Thus, one cannot discern the specific location of any of the symbols on the annular row 82 of symbols 84 disposed on the periphery 90 of the reel 80.

Figure 9:
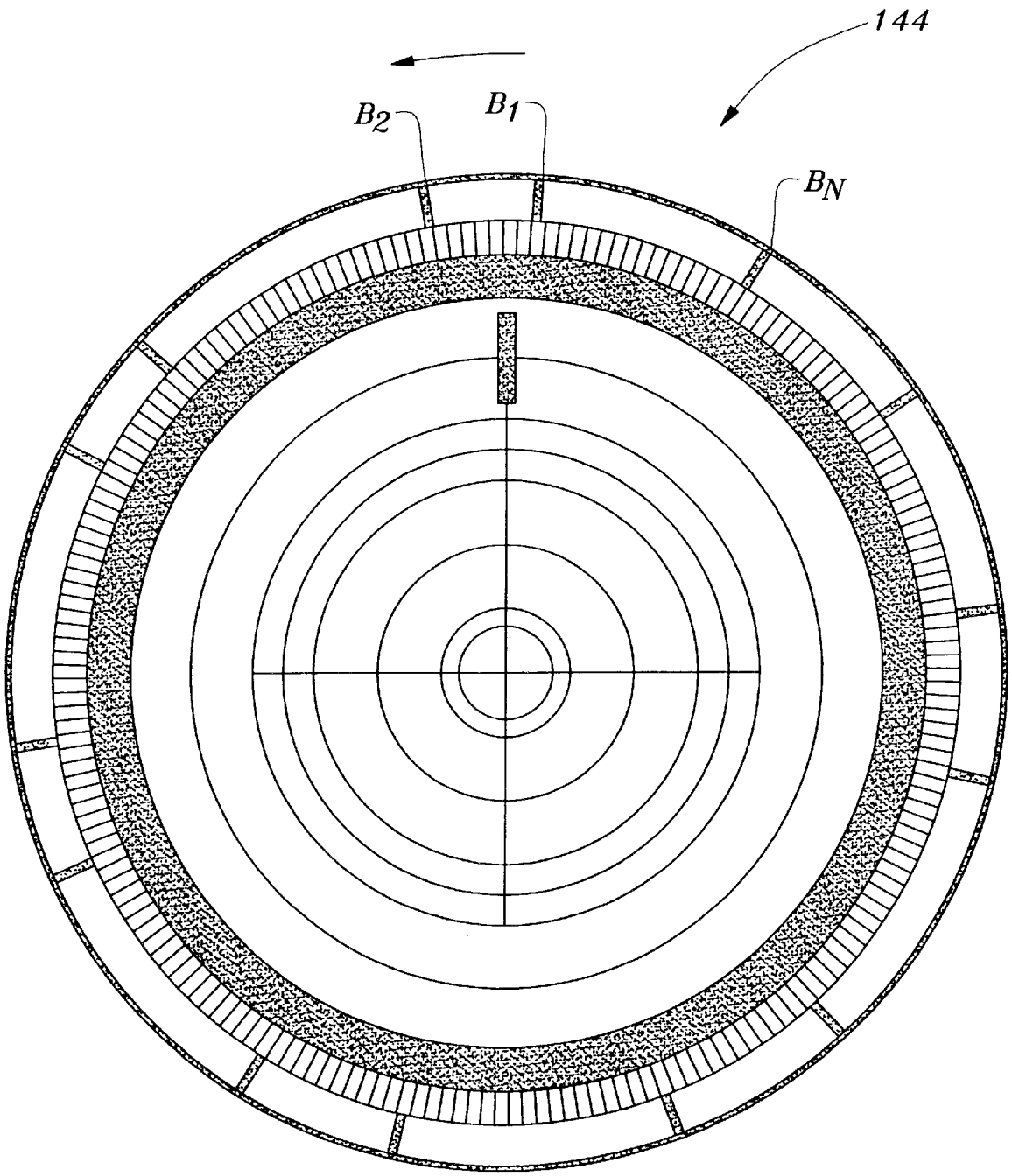
FIG. 9 is a plan side view of a first alternative embodiment of the encoder wheel according to the present invention.
Figure 10:
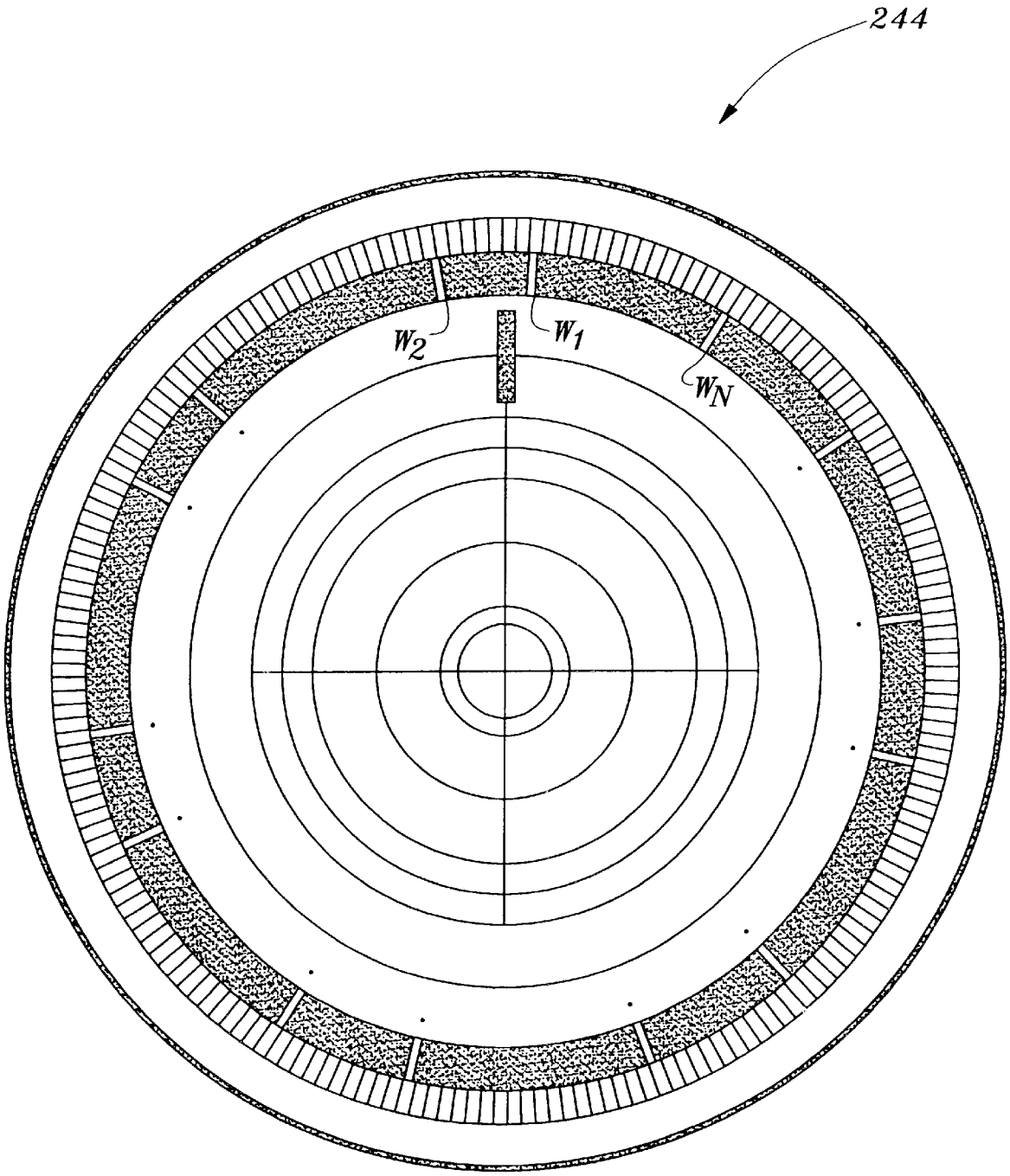
FIG. 10 is a plan side view of a second alternative embodiment of the encoder wheel according to the present invention.

To this end, the present invention provides at least one index band concentrically disposed adjacent the center band 44C (FIG. 9). The index band preferably includes a multiplicity of indexes in the form of bars or windows (FIG. 10) which are each represented by a unique integer number of motor steps and/or slots provided in the center band 44C. Thus, as the rotor shaft 28 is rotated, the unique number of steps/slots between successive bars B or windows W may be determined and the corresponding reel stops associated with each step/slot in any sector may be absolutely determined. Thus, the exact location of each portion of the annular row 82 of symbols 84 and each portion of each disposed symbol 84 on the periphery 90 of the reel 80 may be absolutely discerned.

In the preferred form and referring to FIG. 6, there are two bands 44A, 44C of indexes and at least one band 44B of equiangularly disposed slots concentrically disposed with respect to one another (FIG. 6). The outermost band includes a plurality of indexes in the form of pairs of bars separated by a unique integer number of the equiangularly spaced slots disposed on the center band 44B. The innermost band includes a plurality of indexes in the form of pairs of windows which are radially offset with respect to a corresponding pair of bars. Thus, the sensor monitors both bands simultaneously to obtain a differential signal correlative to whether an index of position has occurred.

By determining the occurrence of a first index position B and a radially adjacent second index position W from the inner and outer bands 44A, 44C and determining the unique number of slots between the first and second index position on the outer band the exact position of the reel shaft 28 and reel 80 is determined without any inference. Thus, the precise location of each symbol 84 and any portion thereof on the annular row 82 of symbols 84 is known such that the processor/controller 70 may send a controlled drive signal to the motor to precisely locate any symbol 84 along the win line 128 of the gaming machine 120.

In addition, the shaft 28 only needs to subtend a small portion of a revolution for the exact direction and position of any symbol to be known. Furthermore, position accuracy is greatly enhanced with the use of multiple indexes per revolution. This provides a high degree of security, for example, gaffing is much more difficult when small movements of the reel 80 and/or encoder wheel 44 produce immediate reel tilts.

Figure 8:
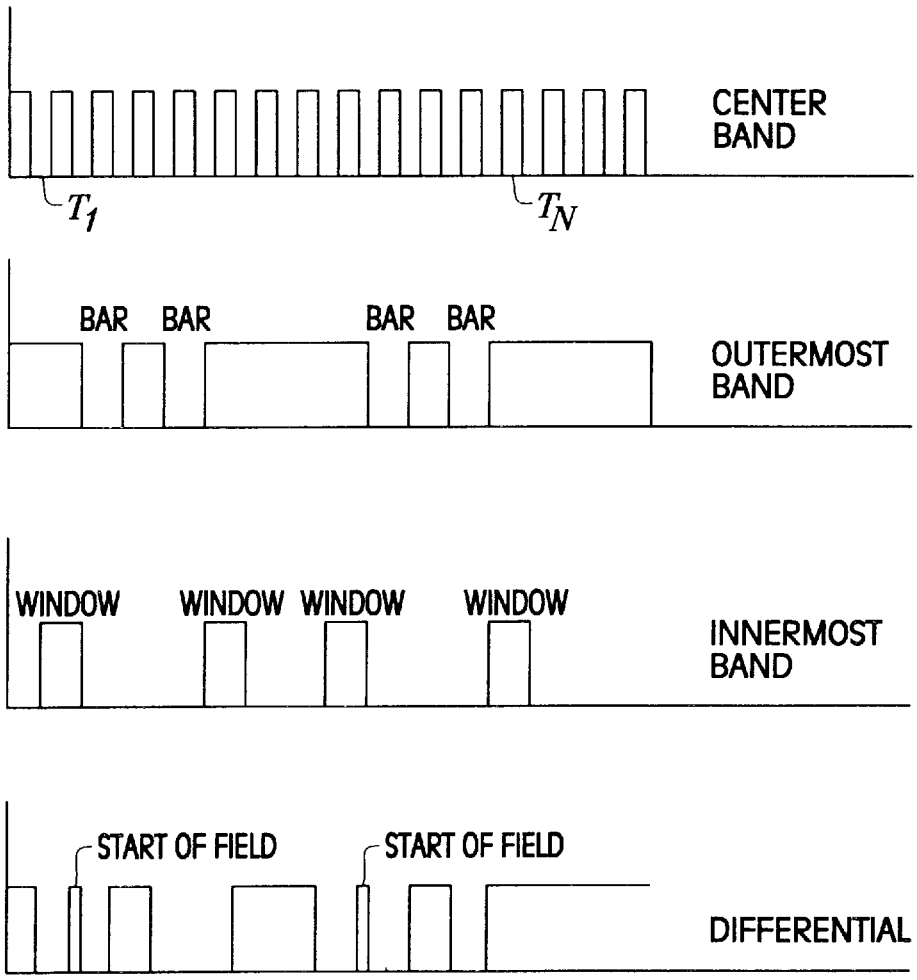
FIG. 8 is an illustrative timing diagram of the response of a sensing means to the rotating encoder wheel shown in FIG. 6.

Referring to FIG. 8, an exemplary timing diagram of the response of the sensing means 46 to the rotating bars B disposed on the outermost band 44C and the windows W disposed on the innermost band 44A. The sensing means 46 monitors both bands simultaneously to obtain a differential signal correlative to whether an index of position has occurred.

Specifically, and referring to FIGS. 6 and 8, of one starts at a reference position T1 (please see FIG. 6) on the encoder wheel 44 and traverses the encoder wheel 44 in a counter clockwise CCW direction to TN, the timing pattern shown in FIG. 8 will be obtained. The upper timing diagram shows the timing pattern of he center band from T1 to TN. The next two timing diagrams are of the outermost band 44C and the innermost band 44A. The last or bottom timing diagram is if a resultant differential signal obtained from the timing diagrams of the outermost and innermost bands 44C and 44A. FIG. 8 reveals that when the timing diagram for the outermost band 44C and the timing diagram from the innermost band 44A are used to form a differential signal, a unique index signal is obtained. If the sensor senses a window W and then immediately senses a bar, the sensing means 46 output (ID) will be a differential signal spike followed by a constant pulse. Thus, the differential signal reveals when an index has occurred. Therefore, once an index has been positively identified, a counter means 72 associated with the processor/controller 70 may begin counting the number N of slots.

In use and operation, and referring to FIG. 5, for example, a slot machine 120 is shown which includes a base 122 having a top surface 123 and a housing 124 supported by the top surface 123 of the base 122 and upwardly extending therefrom. A plurality of the reel mechanisms 10 according to the present invention are shown coaxially aligned and coupled to the top surface 123 of the base 122 by a plurality of support brackets 100. A housing 124 encloses both the reel mechanisms 10 and support brackets 100.

Typically, the play of the slot machine 120 is initiated by a player making a wager by inserting a token, which may be a coin or the like into a slot 134, a dollar bill in a bill validator 135 or by scanning a player card 136 through a reader 138 located on the slot machine 120. The player then actuates the slot machine 120 by pulling a handle 130 or pressing a button 132 disposed on machine 120. Upon actuation of the handle 130 or the button 132, the slot machine 120 starts the reels 80 in motion. After the reels 80 have stopped, certain combinations of symbols 84 will appear adjacent at least one win line 128 in the visible field 126. The resulting combination of symbols 84 (the outcome) appearing adjacent the win line 128 yields a score which is derived from a predetermined table of scores (a pay table ). Typically, if a combination of symbols 84 along the win line 128 corresponds to a winning combination, a corresponding number of coins or tokens are paid out through a chute 140 and on into a tray 142. Alternatively, the corresponding winnings may be credited to the account of the person using the player card 136.

There are a plurality of methods for determining the outcome of a game in use today: direct, virtual and weighted reel strips. The first method, direct reel strips, has a one-for-one representation of the annular row of symbols in a memory means which corresponds with a physical annular row of symbols display W on the reel. If the reel has twenty-two stops, so does the processor/controller representation of the reel. The second method, virtual reel strips, has a larger number of possible symbols in memory than appear on the physical reel. Each virtual stop in memory has associated with it a position on the reel. The third method, weighted reel strips, is a method of achieving the same goals as the virtual reel strip method. The processor/controller representation of the reel has the same number of symbols on physical reel, but has associated with it a weight or likelihood of being chosen.

Each reel 80 is provided with an annular row of symbols on its periphery and is driven stopped by the stepping motor 22 associated therewith. Each reel 80 is caused to be rotated by a player placing a wager and then pulling a lever arm 30 or pushing a actuator button 132. The reels 80 subsequently come to a stop and display one of the symbols 84 or a portion thereof in a window 126 disposed in the housing 124 such that the symbols 84 or a portion of the symbols lie along a win line 128. The symbols 84 or portion thereof which lie along the win line 128 may or may not cause a pay out based upon a predetermined table of winning combinations.

Figure 11:
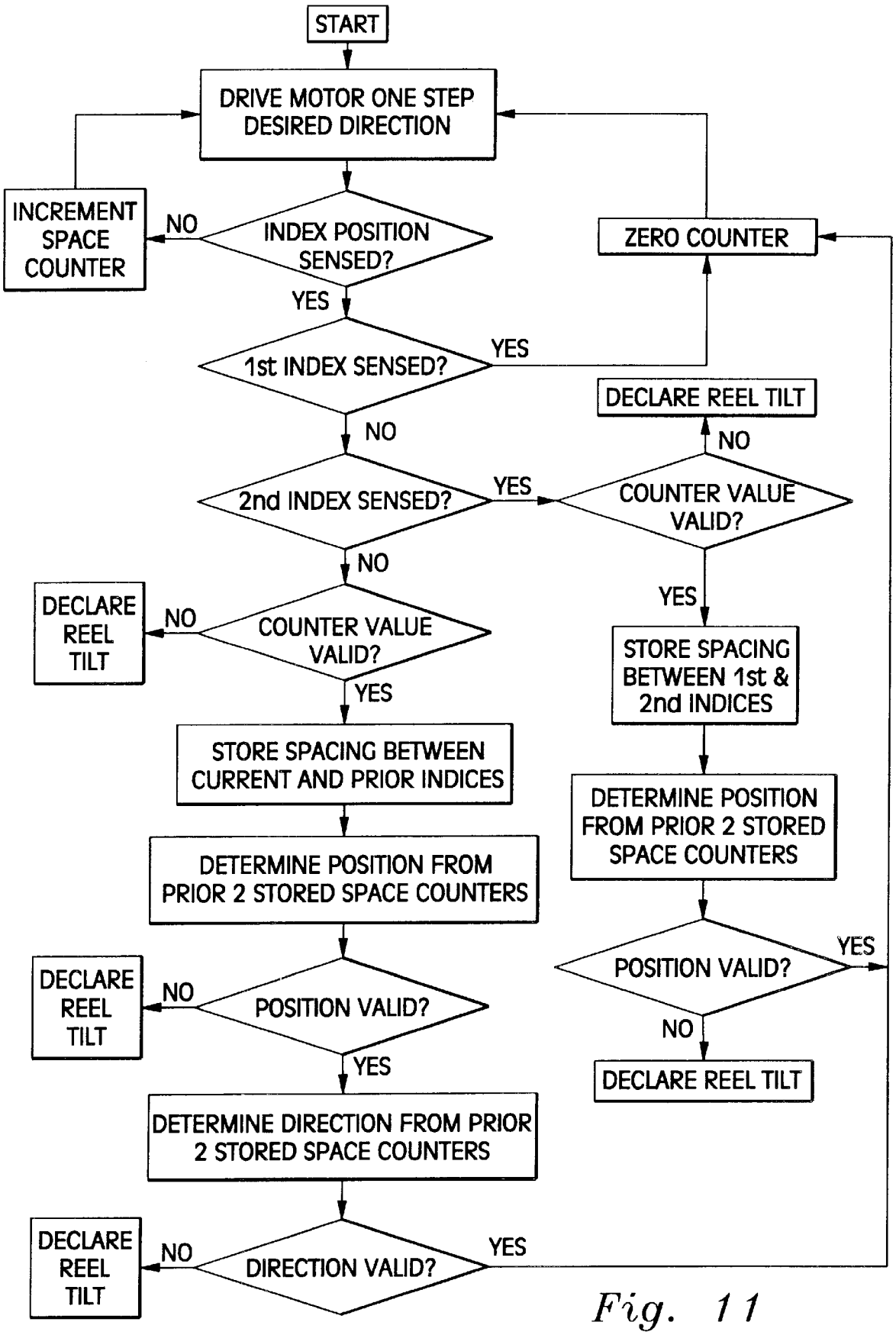
FIG. 11 is a flow diagram of a procedure for determining a reel position and direction.

Referring to FIGS. 2, 5 and 11, each reel 80 is provided with an annular row of symbols 82 and is driven and stopped by the stepping motor 22 under the control of the processor/controller 70. Each reel 80 is caused to be rotated by the player placing a wager and then actuating the lever arm 130 or the push button 132. Once the game has been initiated, the stepping motor 22 is incrementally stepped in a desired direction until a bar index position is sensed. The processor/controller 70 then discerns whether this index position is a first index position, for example, bar B1 (please see FIG. 6). If in fact the sensed index position is a first index position which starts a uniquely defined sector, a signal is sent by the processor/controller 70 to a counter means 72 to zero the counter means out. As the reel 80 continues to rotate, the sensing means 46 in cooperation with the processor/controller 70 continues to drive the stepping motor to sense a second index, for example, B2. If a first index, for example, B1 has been previously sensed and a subsequent index position is sensed, the processor/controller 70 verifies that this subsequent index is in fact a second index closing out the sector started by the sensing of the first index. If it is determined that the subsequent index is not the second index, for example, B2 then the processor/controller 70 discerns whether the counter value in the counter means 72 is valid. If the processor/controller 70 discerns that the counter value is an invalid value, it will declare a reel tilt. Alternatively, if the counter value is in fact a valid value, the processor/controller 70 will store the spacing between the current index. for example B2, and the prior index, for example B1. Thus, the position may be determined from the prior two stored space counts and a position resulting therefrom will be determined to be valid or invalid by the processor/controller 70. If the processor/controller 70 discerns that the position is an invalid one, a reel tilt will be declared. If the processor/controller 70 discerns that the position is a valid one, the direction of the reel is discerned and if valid will reset the counter means 72 or if invalid will declare a reel tilt.

If the subsequent sensed index is a second index, for example B2, the processor will verify whether the counter value is valid or not. If the counter value is invalid, a reel tilt will be declared. If the counter value is valid the spacing between the first and second indexes, for example between B1 and B2, will be stored in memory means 74. Thus, the absolute position of the reel may be determined from the stored position between the first and second indexes. The processor/controller 70 will determine if this position is a valid position. If the position is valid the microprocessor/controller 70 will reset the counter means 72 to zero. If the processor/controller discerns that the position is an invalid one, it will declare a reel tilt.

Thus, when the game is initiated, the processor/controller 70 signals the stepping motor 22 to spin the reel 80 and while the reel 80 is spinning, the random number generator means 76 associated with the processor/controller 70 determines a pre-programmed reel stop associated with a physical position on the reel correlative to the symbols disposed on a periphery thereof. Simultaneously, the processor/controller 70 cooperates with the integrally formed encoder means 42 to provide a precise and fast response time in determining reel spin direction and absolute reel position to precisely control the stepping motor drive signals to stop the reel 80 such that a portion of the annular row 82 of various symbols 84 which is associated with the reel stop determined by the random number generator means properly appears in the visible field 126.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method for forming an apparatus for assessing position of at least one reel vis-a-vis reward obligations based on a position of said reel, the steps including:

scanning a plurality of concentrically disposed bands of indicia coupled to a motor which in turn drives a reel, communicating signals corresponding to said scanned indicia to a controller for determining reel position, randomly deciding a next reel stop position, and directing the controller to stop the reel at the next reel stop position.

2. The method of claim 1 wherein scanning the plurality of concentrically disposed bands of indicia includes scanning a first band of indicia in the form of spaced slots which produce a symmetrical pulse train which is communicated to the controller.

3. The method of claim 2 wherein scanning the plurality of concentrically disposed bands of indicia includes scanning a second band of indicia in the form of bars separating windows, each window having a unique number of slots associated therewith for identifying reel position.

4. The method of claim 3 furthering including the step of providing the reel with an annular series of various symbols of a game and associating each symbol with a specific reel position.

5. An apparatus for assessing position of at least one reel vis-a-vis reward obligations based on a position of said reel, comprising in combination:

indicia means operatively coupled to a motor, said indicia means including a plurality of coded sectors, each sector having a unique identity, said one reel operatively coupled to said motor, sensing means addressing said indicia means, means to power said motor and communicating with said sensor, and random number generating means interposed between said sensing means and said power means to control reel position as a function of said coded sectors.

6. The apparatus of claim 5 wherein said indicia means includes an encoder wheel having a plurality of concentrically disposed bands of indicia.

7. The apparatus of claim 6 wherein at least one of said plurality of concentrically disposed bands of indicia is formed by a plurality of spaced slots.

8. The apparatus of claim 7 wherein at least one of said plurality of concentrically disposed bands of indicia is formed by a plurality of windows separated by at least one bar.

9. The apparatus of claim 8 wherein each window is represented by a number of slots which define said plurality of coded sectors.

10. A reel mechanism for use in a gaming machine, comprising in combination:

a reel having an annular series of various symbols of the gaming machine disposed about a periphery of said reel;

a motor operatively coupled to said reel;

said motor including a stator and a rotor having a rotor shaft, said rotor shaft having a first end and a second end;

said first end of said rotor shaft operatively coupled to said reel wherein said annular series of various symbols forms an outer apron about said motor;

a disk, said disk operatively coupled to said second end of said rotor shaft;

said disk having a plurality of concentrically disposed bands of indicia having a fixed relationship with respect to one another;

said plurality of concentrically disposed bands of indicia including at least a first band and a second band;

said first band having a plurality of equiangularly spaced indicia disposed thereon;

said second band having a plurality of indicia in the form of indexes which are separated by a unique integer number of said equiangularly spaced indicia disposed on said first band;

a sensor means strategically disposed adjacent said concentrically disposed bands of indicia for sensing and outputting a signature signal representative of the integer number of said equiangularly disposed indicia which subtend an arc between two consecutive sensed indexes disposed on said second band wherein a processor/controller operatively coupled to said sensor controls reel position and direction of said reel based on said sensed signature signal.

11. A reel mechanism for use in a gaming machine, comprising, in combination:

an integrally formed encoder and motor;

a reel having an annular series of various symbols of the gaming machine disposed about a periphery of said reel;

said reel rotatably coupled to said motor;

said encoder including means for serially scanning a plurality of coded sectors of indicia coupled to the motor which in turn drives the reel for determining a reel position signature, a feedback loop operatively coupled between said encoder and a processor for communicating said signature correlative to each scanned sector of indicia to said processor for directing the motor to stop the reel at a predetermined next reel stop position;

wherein said processor correlates the position of said reel vis-a-vis reward obligations based on a paytable.

12. The reel mechanism of claim 11 wherein said encoder includes means for determining a resultant differential signal correlative to the absolute position of the reel;

said encoder including means to output said resultant differential signal correlative to the absolute position of the reel to said processor forming a closed loop system;

wherein said position of said reel is automatically monitored and optimized during game play.

13. A reel mechanism for use in a gaming machine, comprising, in combination:

a reel having a series of symbols disposed thereon;

a motor operatively coupled to said reel for driving said reel;

a plurality of indicia bands operatively coupled to said motor;

said plurality of indicia bands including at least a first band and a second band of indicia;

said first band having a plurality of spaced indicia;

said second band having a plurality of indicia in the form of indexes which are separated by a number of said spaced indicia included in said first band;

a sensor means disposed in operative communication with said plurality of indicia bands for sensing and outputting a signature signal representative of said number of said spaced indicia which subtend an arc between at least two sensed indexes included in said second band;

a processor/controller operatively coupled to said sensor for receiving said signature signal representative of said number of said spaced indicia between at least two sensed indexes wherein absolute reel position is determined from said sensed signature signal.

14. The reel mechanism of claim 13 wherein said processor/controller produces a first and a second signal wherein the first signal leads the second signal in reel rotation which is clockwise and the second signal leads the first signal in reel rotation which is counterclockwise thereby determining a rotational direction of said reel.

15. A reel mechanism for use in a gaming machine, comprising, in combination:

a reel having a series of symbols disposed thereon;

a motor operatively coupled to said reel for driving said reel;

a plurality of indicia bands operatively coupled to said motor;

said plurality of indicia bands including at least a first band, a second band and a third band of indicia;

said first band including a plurality of spaced bars, said second band including a plurality of spaced slots and said third band including a plurality of windows radially offset with respect to at least one corresponding bar;

a sensor means disposed in operative communication with said plurality of indicia bands for sensing and outputting a signature signal representative of said number of said spaced slots between at least one said bar and at least one said window;

a processor/controller operatively coupled to said sensor for receiving said signature signal representative of said number of said spaced slots between at least one said bar and at least one said window wherein absolute reel position is determined from said sensed signature signal.

* * * * *